US010845106B2

(12) United States Patent
McKim

(10) Patent No.: US 10,845,106 B2
(45) Date of Patent: Nov. 24, 2020

(54) ACCUMULATOR AND OIL SEPARATOR

(71) Applicant: Rheem Manufacturing Company, Atlanta, GA (US)

(72) Inventor: Paul D. McKim, Fort Smith, AR (US)

(73) Assignee: Rheem Manufacturing Company, Altanta, GA (US)

( * ) Notice: Subject to any disclaimer, the term of this patent is extended or adjusted under 35 U.S.C. 154(b) by 79 days.

(21) Appl. No.: 15/839,576

(22) Filed: Dec. 12, 2017

(65) Prior Publication Data

US 2019/0178543 A1 Jun. 13, 2019

(51) Int. Cl.

| | |
|---|---|
| ***F25B 41/06*** | (2006.01) |
| ***F25B 30/02*** | (2006.01) |
| ***F25B 41/00*** | (2006.01) |
| ***F25B 43/02*** | (2006.01) |
| ***F25B 43/00*** | (2006.01) |

(Continued)

(52) U.S. Cl.

CPC ..... *F25B 41/067* (2013.01); *F25B 13/00* (2013.01); *F25B 30/02* (2013.01); *F25B 31/002* (2013.01); *F25B 31/004* (2013.01); *F25B 41/00* (2013.01); *F25B 41/003* (2013.01); *F25B 43/006* (2013.01); *F25B 43/02* (2013.01); *F25B 45/00* (2013.01); *F25B 2300/00* (2013.01); *F25B 2400/07* (2013.01); *F25B 2400/16* (2013.01); *F25B 2400/18* (2013.01);

(Continued)

(58) Field of Classification Search

CPC ..... F25B 43/006; F25B 43/02; F25B 41/00; F25B 41/003; F25B 41/067; F25B 31/004; F25B 31/002; F25B 2400/07; F25B 2400/18; F25B 2400/23; F25B 2400/16; F25B 2500/01; F25B 30/02; F25B 45/00

See application file for complete search history.

(56) References Cited

U.S. PATENT DOCUMENTS 3,149,479 A * 9/1964 Peterson ..... F25B 39/04 62/474
4,030,315 A * 6/1977 Harnish ..... F25B 13/00 62/324.4

(Continued)

FOREIGN PATENT DOCUMENTS

JP H04187957 A * 7/1992
JP 2008202894 A * 9/2008

(Continued)

OTHER PUBLICATIONS

Yeong, Accumulator-Oil Separator Assemble (Year: 2002).*

(Continued)

*Primary Examiner* — Len Tran
*Assistant Examiner* — Jenna M Hopkins
(74) *Attorney, Agent, or Firm* — Troutman Pepper Hamilton Sanders LLP

(57) ABSTRACT

An accumulator and oil separator device includes a housing having a cavity, an oil separator unit disposed in the cavity and designed to separate oil from a refrigerant and oil mix received from a compressor and to output the oil into the cavity. The accumulator and oil separator device further includes an accumulator inlet tube to carry a received refrigerant into the cavity. The accumulator and oil separator device also includes an accumulator outlet tube to output the received refrigerant and the oil from the cavity.

19 Claims, 6 Drawing Sheets

(51) Int. Cl.
*F25B 45/00* (2006.01)
*F25B 31/00* (2006.01)
*F25B 13/00* (2006.01)

(52) U.S. Cl.
CPC ..... *F25B 2400/23* (2013.01); *F25B 2500/01* (2013.01); *F25B 2500/16* (2013.01); *F25B 2700/03* (2013.01)

(56) References Cited

U.S. PATENT DOCUMENTS 4,354,362 A * 10/1982 Schumacher ..... B01D 15/00 210/DIG. 6
4,768,355 A * 9/1988 Breuhan ..... F25B 43/006 261/DIG. 6
4,810,375 A * 3/1989 Hudgins ..... B01D 17/04 210/112
5,029,455 A * 7/1991 Backus ..... F25B 31/004 62/470
5,040,382 A * 8/1991 Abraham ..... F25B 43/02 62/149
5,203,177 A * 4/1993 Manz ..... F25B 45/00 62/149
5,401,404 A * 3/1995 Strauss ..... B01D 17/0208 210/265
5,535,596 A * 7/1996 Todack ..... F25B 45/00 62/149
6,167,720 B1 * 1/2001 Chisnell ..... F25B 43/003 62/474
6,196,019 B1 * 3/2001 Higo ..... B60H 1/3229 62/474
6,327,868 B1 * 12/2001 Furuya ..... F25B 31/00 62/129
6,681,597 B1 * 1/2004 Yin ..... F25B 40/00 62/503
6,701,745 B1 * 3/2004 Kozinski ..... B60H 1/323 62/244
10,215,461 B2 * 2/2019 Hosokawa ..... F25B 43/00
10,401,047 B2 * 9/2019 Kato ..... F25B 43/006
10,627,141 B2 * 4/2020 Ayub ..... B01D 46/2403
2001/0032478 A1 * 10/2001 McAllister ..... B01D 53/0415 62/509
2006/0010905 A1 * 1/2006 Gu ..... F25B 40/00 62/503
2006/0196219 A1 * 9/2006 McGregor ..... F25B 43/003 62/470
2008/0041093 A1 * 2/2008 Sung ..... F25B 43/006 62/503
2008/0173425 A1 * 7/2008 Wiggs ..... F25B 30/06 165/45
2009/0107170 A1 * 4/2009 Yoon ..... F25B 43/006 62/468
2009/0272137 A1 * 11/2009 Wiggs ..... F25B 30/06 62/260
2011/0011105 A1 * 1/2011 Valiya Naduvath .... F25B 43/02 62/84
2012/0079846 A1 * 4/2012 Jin ..... F25B 43/006 62/512
2012/0117996 A1 * 5/2012 Hinde ..... F25B 7/00 62/192
2012/0234037 A1 * 9/2012 Tadano ..... F25B 43/02 62/470
2014/0026609 A1 * 1/2014 Tadano ..... F25B 43/02 62/470
2014/0331713 A1 * 11/2014 Takeda ..... F25B 43/006 62/503
2016/0245563 A1 * 8/2016 Kudo ..... F25B 13/00

FOREIGN PATENT DOCUMENTS

JP 5940489 B2 * 6/2016
KR 20020071232 A * 9/2002
WO WO-9119140 A1 * 12/1991 ..... F25B 43/006
WO WO-2012012491 A2 * 1/2012 ..... F25B 43/006
WO WO-2015029204 A1 * 3/2015 ..... F25B 43/006
WO WO-2016117128 A1 * 7/2016 ..... F25B 41/04

OTHER PUBLICATIONS

Sugimori, Oil Separator (Year: 2008).*
JP H04187957 A—English Machine Translation (Year: 1992).*
WO 9119140 A (Year: 1991).*

* cited by examiner

ACCUMULATOR AND OIL SEPARATOR

TECHNICAL FIELD

The present disclosure relates generally to air conditioning and heat pump systems, and more particularly to an accumulator and oil separator device for use in such systems.

BACKGROUND

In general, compressors used in air conditioning systems and heat pump systems are designed to compress vapor refrigerant. In view of the incompressibility of liquids by compressors, it is generally desirable to prevent a liquid refrigerant from reaching a compressor. In some cases, an accumulator may be used in the refrigerant path to the compressor to prevent a refrigerant from reaching the compressor in a liquid form. For example, refrigerant may enter the accumulator in liquid form under some operating conditions, such as low temperature conditions, and when the system is started after being idle for a long period.

In some air conditioning systems and heat pump systems that include an accumulator, the use of an oil separator may also be desirable. To illustrate, some of the oil that is used to lubricate the compressor typically enters the refrigerant line of an air conditioning system and a heat pump system along with the refrigerant. In some case, the amount of the lubricant oil that leaves the compressor may be large enough to result in damage to the compressor due to reduced lubrication. In some cases, the amount of oil that remains in the refrigerant line from the compressor may be also large enough to affect the heat transfer capability of other components of air conditioning and heat pump systems. To prevent undesired effects of oil leaving the compressor, an oil separator can be used to return the oil that enters the refrigerant line back to the compressor. In general, a separate oil return line is used to return the separated oil back from the oil separator to the compressor. In some cases, limited availability of space may present challenges to install both an accumulator and an oil separator and to route the oil return line back to the compressor.

Thus, a solution that overcomes challenges associated with separate accumulator and oil separator components is desirable.

SUMMARY

The present disclosure relates generally to air conditioning and heat pump systems, and more particularly to an accumulator and oil separator device for use in such systems. In some example embodiments, an accumulator and oil separator device includes a housing having a cavity, an oil separator unit disposed in the cavity and designed to separate oil from a refrigerant and oil mix received from a compressor and to output the oil into the cavity. The accumulator and oil separator device further includes an accumulator inlet tube to carry a received refrigerant into the cavity. The accumulator and oil separator device also includes an accumulator outlet tube to output the received refrigerant and the oil from the cavity.

In another example embodiment, an air conditioning system includes an evaporator coil, a condenser coil, a compressor, and an accumulator and oil separator device. The compressor is in fluid communication with the evaporator coil and the condenser coil through the accumulator and oil separator device. The accumulator and oil separator device includes a housing having a cavity, an oil separator unit disposed in the cavity and designed to separate oil from a refrigerant and oil mix received from the compressor, where the oil separator unit outputs the oil into the cavity. The accumulator and oil separator device further includes an accumulator inlet tube to carry a refrigerant into the cavity. The accumulator and oil separator device also includes an accumulator outlet tube to output the refrigerant and the oil from the cavity to the compressor.

In another example embodiment, a heat pump system includes an indoor coil, an outdoor coil, a compressor, a reversing valve, and an accumulator and oil separator device. The compressor is in fluid communication with the indoor coil and the outdoor coil through the accumulator and oil separator device and the reversing valve. The accumulator and oil separator device includes a housing having a cavity, and an oil separator unit disposed in the cavity and designed to separate oil from a refrigerant and oil mix received from the compressor, where the oil separator unit outputs the oil into the cavity. The accumulator and oil separator device further includes an accumulator inlet tube to carry a refrigerant into the cavity. The accumulator and oil separator device also includes an accumulator outlet tube to output the refrigerant and the oil from the cavity to the compressor.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
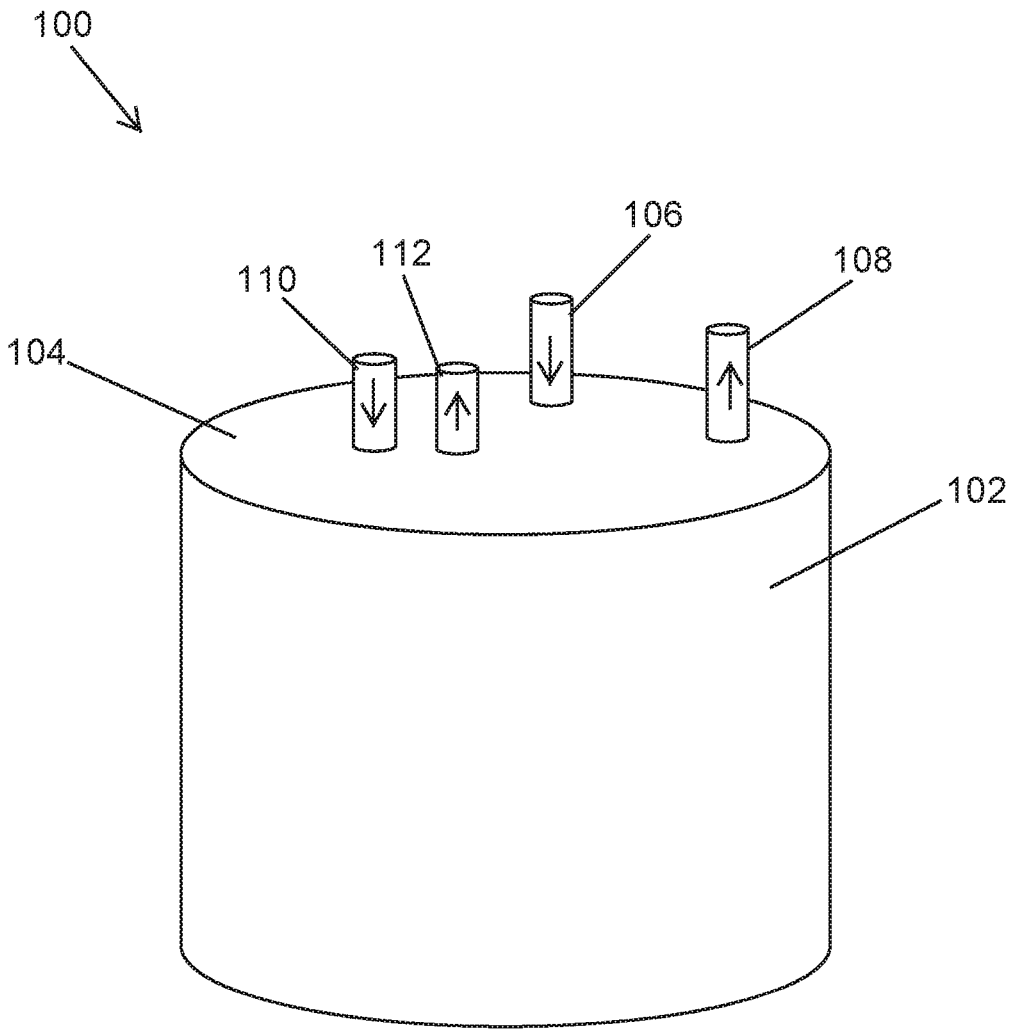
FIG. 1 illustrates an accumulator and oil separator device according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates an accumulator and oil separator device 100 according to an example embodiment. The accumulator and oil separator device 100 is designed to be integrated in compressor-driven air conditioning systems and heat pump systems. The accumulator and oil separator device 100 may prevent a refrigerant from reaching a compressor in liquid form and may also separate oil from a refrigerant and oil mix and return the oil to the compressor.

In some example embodiments, the accumulator and oil separator device 100 includes a housing 102, an accumulator inlet tube 106, an accumulator outlet tube 108, an oil separator inlet tube 110, and an oil separator outlet tube 112. The tubes 106-112 may provide passageways to and from a cavity of the housing 102. For example, some or all of the tubes 106-112 may extend through a top wall 104 of the housing 102 into the cavity of the housing 102. The tubes 106-112 may be soldered or brazed to the top wall 104 of the housing 102 to securely attach the tubes 106-112 to the housing 102.

In some example embodiments, the accumulator and oil separator device 100 may prevent a large amount of refrigerant from reaching a compressor in liquid form. For example, the accumulator and oil separator device 100 may receive a refrigerant through the accumulator inlet tube 106, which carries the refrigerant into the cavity of the housing 102. In some cases, the received refrigerant may include a liquid portion that can damage a compressor if received by the compressor in liquid form. To avoid such damage to the compressor, the accumulator and oil separator device 100 can be placed in the suction line of air condition systems and heat pump systems to prevent the liquid portion of the refrigerant from reaching the compressor of such systems. For example, the liquid portion of the refrigerant received through the accumulator inlet tube 106 may be vaporized in the accumulator and oil separator device 100, for example, due to a pressure differential, through the accumulator and oil separator device 100. The partially liquid refrigerant received by the accumulator and oil separator device 100 exits the accumulator and oil separator device 100 in vapor form through the accumulator outlet tube 108.

In some example embodiments, an oil separator unit is disposed inside the housing. To illustrate, the oil separator unit may receive a refrigerant and oil mix from a compressor and may extract the oil from the refrigerant and oil mix or otherwise separate the oil from the refrigerant in the refrigerant and oil mix. To illustrate, the oil separator inlet tube 110 may carry the refrigerant and oil mix from outside of the housing into the oil separator unit inside the housing 102. For example, the oil separator inlet tube 110 may be coupled to the discharge line of an air conditioning or heat pump system to receive the refrigerant and oil mix. The oil separator unit may output the separated refrigerant from the accumulator and oil separator device 100 through the oil separator outlet tube 112. The oil separator unit may output the separated oil into the cavity of the housing 102, where the separated oil exits the housing 102 through the accumulator outlet tube 108 as described on more detail below.

By limiting a large amount of liquid refrigerant from reaching a compressor and by separating and returning lubricant oil back to the compressor, the accumulator and oil separator device 100 reduces the risk of damage or inefficient operation while eliminating the need for separate spaces required to install multiple devices. The accumulator and oil separator device 100 further eliminates the need to provide a separate oil return line to the compressor.

In some example embodiments, the accumulator and oil separator device 100 may be made from one or more materials such as steel, copper, etc. using methods such as cutting, bending, welding, etc. Although the tubes 106-112 are shown at particular locations on the top wall 104 of the housing 102, in alternative embodiments, the tubes 106-112 may be at different locations without departing from the scope of this disclosure. In some alternative embodiments, the housing 102 and the tubes 106-112 may each have a different shape than shown without departing from the scope of this disclosure.

Figure 2:
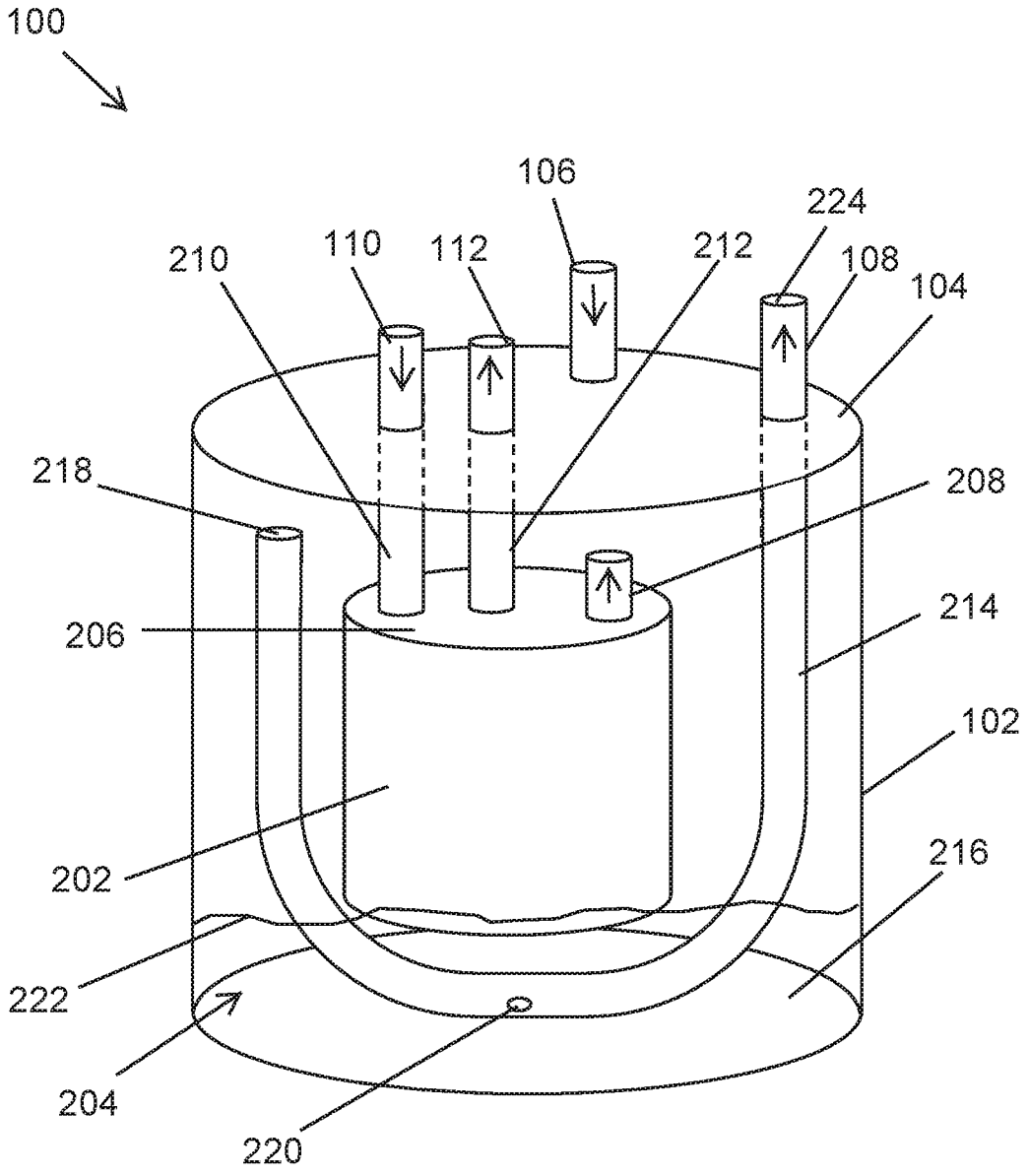
FIG. 2 illustrates the inside of the accumulator and oil separator device of FIG. 1 according to an example embodiment.

FIG. 2 illustrates the inside of the accumulator and oil separator device 100 of FIG. 1 according to an example embodiment. Referring to FIGS. 1 and 2, the accumulator and oil separator device 100 includes the oil separator unit 202 that is disposed in a cavity 204 of the housing 102. The housing 102 includes a bottom wall 216 that encloses the cavity 204 on a bottom side of the housing 102.

In some example embodiments, the oil separator unit 202 may be suspended in the cavity or may alternatively be positioned on the bottom wall 216. For example, the oil separator unit 202 may be suspended from the top wall 104 by tubes 210, 212. The tube 210 may be a portion of the oil separator inlet tube 110, and the tube 212 may be a portion of the oil separator outlet tube 112. The oil separator inlet tube 110 and the oil separator outlet tube 112 may be securely attached to the top wall 104, for example, by brazing or other means at the contact areas of the tubes 110, 112 with the top wall 104.

As described above, the accumulator and oil separator device 100 may receive a refrigerant through the accumulator inlet tube 106, which transports the refrigerant into the cavity 204 of the housing 102. A liquid portion of the refrigerant, when present, may be vaporized in the housing 102. The refrigerant in the cavity 204 may exit the housing 102 through the accumulator outlet tube 108 in a vapor form. To illustrate, the refrigerant received in the cavity 204 may enter a refrigerant inlet opening 218 of the accumulator outlet tube 108 in vapor form, flow through a pipe 214, and exit the accumulator outlet tube 108 through a refrigerant outlet opening 224 of the accumulator outlet tube 108. The tube 214 may be a portion of the accumulator outlet tube 108.

The refrigerant inlet opening 218 of the accumulator outlet tube 108 may be positioned at a level above a surface 222 of a liquid in the cavity 204. For example, the refrigerant inlet opening 218 of the accumulator outlet tube 108 may be proximal to the top wall 104 of the housing 102 and above the oil separator unit 202. To illustrate, the accumulator outlet tube 108 may be a J-shaped tube as shown in FIG. 2 or another suitable tube. The liquid in the cavity 204 may be, for example, oil separated by the oil separator unit 202 from a refrigerant and oil mix received by the oil separator unit 202.

As described above, the oil separator unit 202 may receive a refrigerant and oil mix, for example, from a compressor. The refrigerant and oil mix may be carried into the oil separator unit 202 by the oil separator inlet tube 110 that extends through the top wall 104 of the housing 102. The oil separator unit 202 may separate oil and refrigerant from the refrigerant in the received refrigerant and oil mix and output the refrigerant through the oil separator outlet tube 112 that extends through the top wall 104 of the housing 102. The oil separator unit 202 may output the extracted/separated oil through an oil return tube or port 208. The oil return tube 208 is designed to output the separated oil into the cavity 204 of the housing 102.

In some example embodiments, the tubes 208, 210, 212 may extend into a top cover 206 of the oil separator unit 202. Alternatively, one or more of the tubes 208, 210, 212 may be attached to a respective tube or port providing a respective passageway to and from the inside of the oil separator unit 202.

In some example embodiments, the tube 214 may include a metering orifice 220 that allows the oil in the cavity to enter the tube 214 in a controlled manner. The oil that is metered into the tube 214 may exit the accumulator and oil separator device 100 through the refrigerant outlet opening 224 of the accumulator outlet tube 108. The oil may exit the accumulator and oil separator device 100 through the refrigerant outlet opening 224 along with the refrigerant that entered the refrigerant inlet opening 218 of the accumulator outlet tube 108. The refrigerant and the separated oil that exit the accumulator and oil separator device 100 through the accumulator outlet tube 108 may be provided to a compressor. For example, the oil and the refrigerant may exit the accumulator and oil separator device 100 through the accumulator outlet tube 108 as a result of the system pressure differential that is present during operations of compressor-driven air condition systems and heat pump systems.

The metering orifice 220 may be positioned such that the oil in the cavity 204 reaches a particular level before the oil is metered into the tube 214. In some example embodiments, the level of the oil in the cavity may be higher than the metering orifice 220 depending on the amount of oil separated from the received refrigerant and oil mix and the rate at which the oil is metered into tube 214 through the metering orifice 220.

In some example embodiments, the oil in the cavity 204 may also include oil that is received by the accumulator and oil separator device 100 through accumulator inlet tube 110. To illustrate, although the accumulator and oil separator device 100 removes and returns to the compressor oil separated from the refrigerant and oil mix, some amount of oil from the compressor may still flow past the oil separator unit 202 and may be received by the accumulator and oil separator device 100 through the accumulator inlet tube 106 along with the refrigerant. The oil that is received through the accumulator inlet tube 106 may accumulate in the cavity 204 of the housing 102 along with the oil separated by the oil separator unit 202. The oil that is received through the accumulator inlet tube 106 along with the separated oil may be metered through the metering orifice 220 and exit the accumulator and oil separator device 100 in the same manner as described with respect to the oil separated by the oil separator unit 202.

In some example embodiments, a portion of the tube 214 may extend below the oil separator unit 202. Alternatively, the tube 214 may be positioned laterally from the oil separator unit 202. In some example embodiments, the tube 214 may be in contact with the bottom wall 216. Alternatively, a gap may exist between the bottom wall 216 and the tube 214.

In some example embodiments, the accumulator and oil separator device 100 including the oil separator unit 202 and the tubes may be made from one or more materials such as steel, copper, etc. using methods such as cutting, bending, welding, etc. For example, the housing 102 and the shell of the oil separator unit 202 may be made from galvanized steel and the tubes may be made from copper. In general, the housing 102, the oil separator unit 202, and the tubes of the accumulator and oil separator device 100 may be sized based on the desired capacity of an air conditioning system and heat pump system.

Because the oil separated by the oil separator unit 202 exits the accumulator and oil separator device 100 through the accumulator outlet tube 108, which is also used to output the received refrigerant from the accumulator and oil separator device 100 in vapor form, an oil return line that is typically used to return oil to a compressor from a stand-alone oil separator will not be required. The accumulator and oil separator device 100 also eliminates the need for separate spaces required to install multiple devices.

Figure 3:
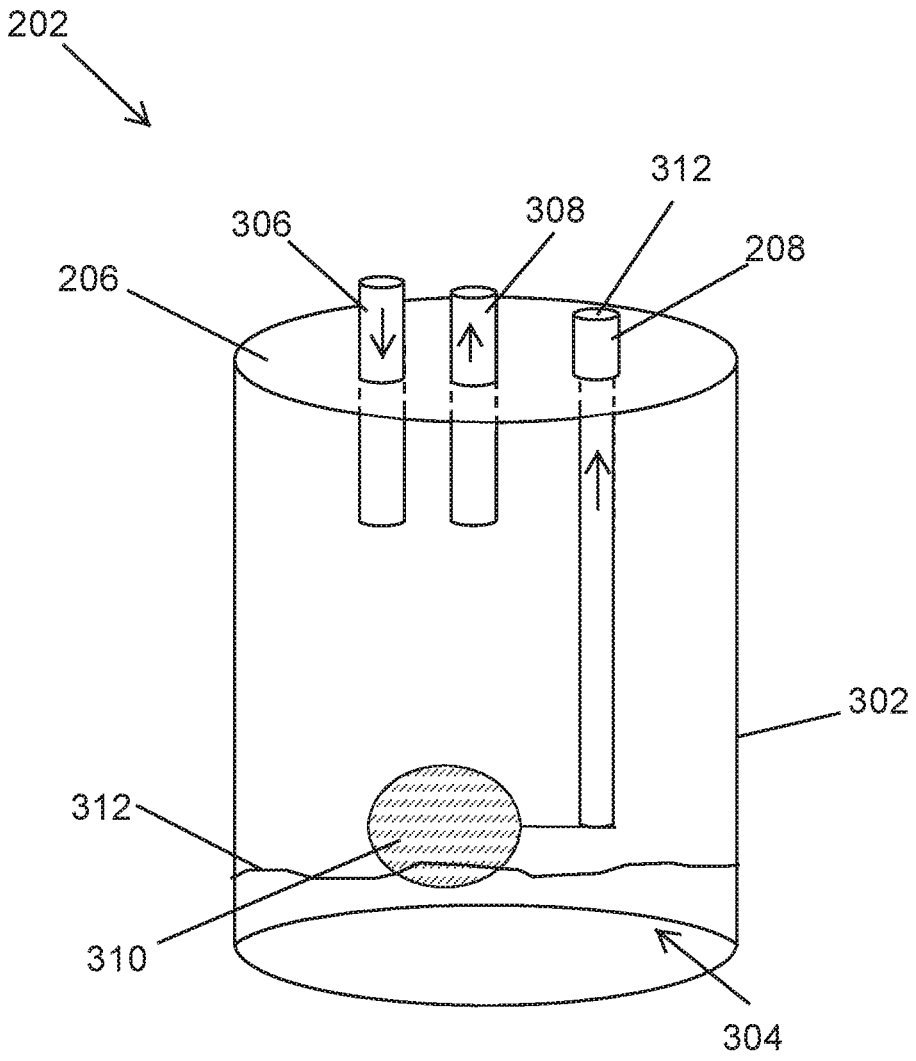
FIG. 3 illustrates the oil separator unit of the accumulator and oil separator device of FIG. 1 according to another example embodiment.

In some alternative embodiments, the oil separator unit 202 and the tubes of the accumulator and oil separator device 100 may be at different locations than shown without departing from the scope of this disclosure. In some alternative embodiments, the tube 210 may be attached to the oil separator inlet tube 110, effectively forming a single tube. In some alternative embodiments, the tube 212 may be attached to the oil separator outlet tube 112, effectively forming a single tube. In some alternative embodiments, the tube 214 may be attached to the accumulator outlet tube 108, effectively forming a single tube. In some example embodiments, the accumulator inlet tube 106 may be terminated at the top wall 204 or may extend lower into the cavity 204 of the housing 102. In some alternative embodiments, the housing 102 and the oil separator unit 202 may each have a different shape than shown without departing from the scope of this disclosure. In some alternative embodiments, the tubes may have different shapes and/or lengths than shown without departing from the scope of this disclosure FIG. 3 illustrates the oil separator unit 202 of the accumulator and oil separator device 100 of FIGS. 1 and 2 according to another example embodiment. Referring to FIGS. 1-3, in some example embodiments, the oil separator unit 202 may include a shell 302 having a cavity 304. The oil separator unit 202 may also include a refrigerant and oil mix inlet tube or port 306, a separated refrigerant outlet tube or port 308, and the oil return tube 208 that extend through the top cover 206 into the cavity 304 of the oil separator unit 202 or that are attached to tubes that are inside of the cavity 304 of the oil separator unit 202.

In some example embodiments, the tube 306 may be attached to the tube 210 (thus to the oil separator inlet tube 110) and allow a refrigerant and oil mix to flow into the oil separator unit 202 from outside the accumulator and oil separator device 100. The tube 210 may be attached to the tube 306 by means such as brazing, screwing, etc. The tube 308 may be attached to the tube 212 and allow the separated refrigerant to flow out of the oil separator unit 202 through the oil separator outlet tube 112, for example, to a compressor. The tube 212 may be attached to the tube 308 by means such as brazing, screwing, etc.

In some example embodiments, the oil separator unit 202 may include a float 310 that controls the output of the separated oil from the cavity 304. For example, the float 310 may control whether the separated oil enters the oil return tube 208 based on the level of a surface 312 of the separated oil in the cavity 304. When the surface 312 of the separated oil reaches a certain level, the float may open an inlet opening of the oil return tube 208 at a bottom of the oil return tube 208 as can be understood by those of ordinary skill in the art with the benefit of this disclosure. The separated oil that enters the oil return tube 208 may exit the oil separator unit 202 through an outlet opening 312 of the oil return tube 208. The separated oil may exit the oil return tube 208 onto the top cover 206. Alternatively, the separated oil may be guided beyond the outer perimeter of the oil separator unit 202 by another tube or by the oil return tube 208 that is shaped differently.

In some alternative embodiments, the oil separator unit 202 may be a different type of oil separator than shown without departing from the scope of this disclosure. For example, the oil separator unit 202 may include other components that facilitate the separation of the oil from the received refrigerant and oil mix.

Figure 4:
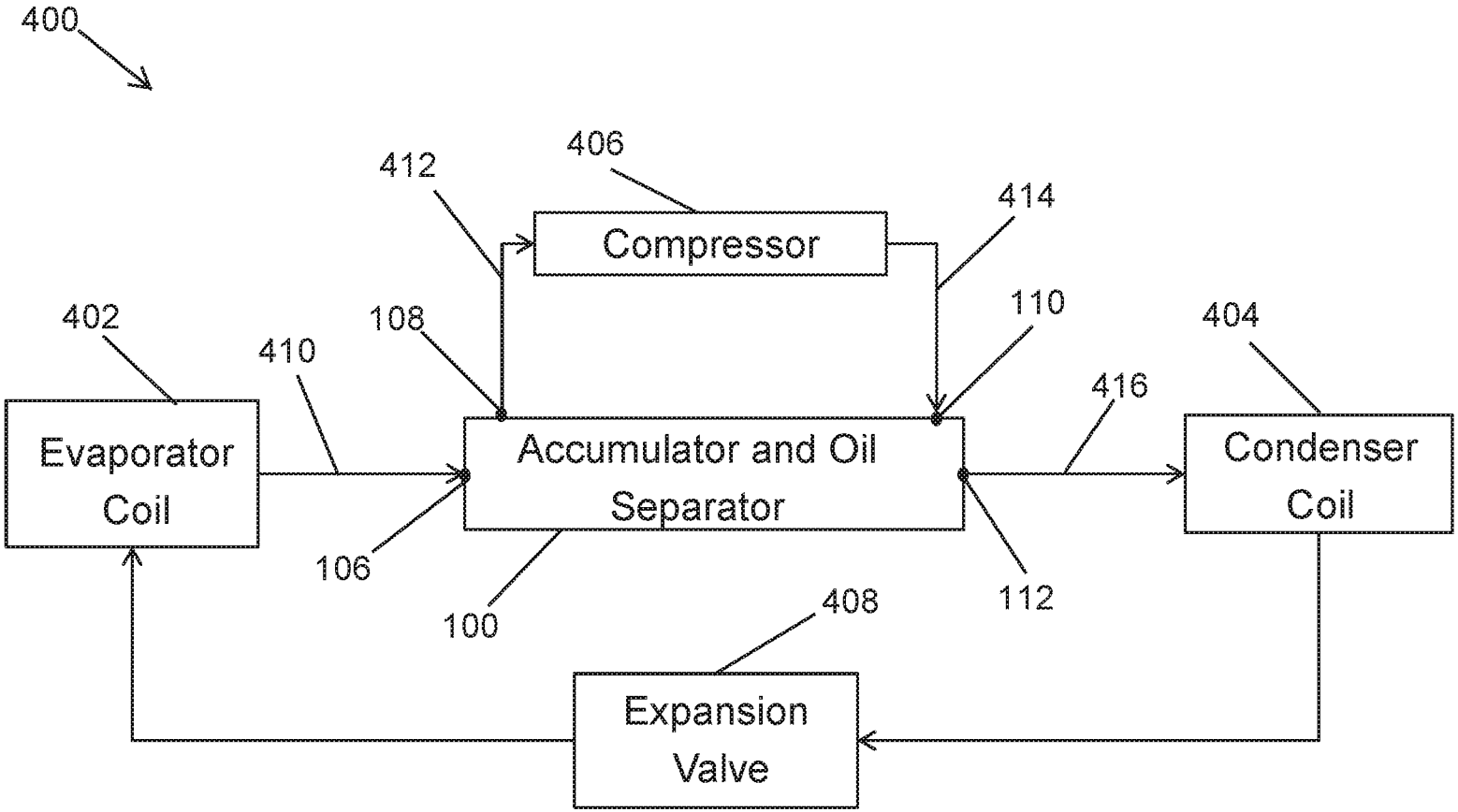
FIG. 4 illustrates an air conditioning system including the accumulator and oil separator device of FIG. 1 according to an example embodiment.

FIG. 4 illustrates an air conditioning system 400 including the accumulator and oil separator device 100 of FIG. 1 according to an example embodiment. Referring to FIGS. 1-4, in some example embodiments, the air conditioning system 400 includes an evaporator coil 402, a condenser coil 404, and a compressor 406. The system 400 may also include an expansion valve 408 in the refrigerant line between the condenser coil 404 and the evaporator coil 402, where the refrigerant used in the system 400 to cool an indoor space flows from the condenser coil 404 to the evaporator coil 402 through the expansion valve 408 as indicated by the arrows of the refrigerant lines of the system 400. In general, the evaporator coil 402 may be a standard indoor coil, and the condenser coil 404 may be a standard outdoor coil, where both of which are sized based on the overall capacity of the system 400.

In some example embodiments, the accumulator and oil separator device 100 is positioned between the evaporator coil 402 and the compressor 406. That is, the refrigerant exiting the evaporator coil 402 flows through the accumulator and oil separator device 100 to reach the compressor 406. To illustrate, a refrigerant pipe 410 may be coupled to the accumulator inlet tube 106 to carry the refrigerant, which may be in a vapor form or mostly in a vapor form, from the evaporator coil 402 to the accumulator and oil separator device 100. A refrigerant pipe 412 may be coupled to the accumulator outlet tube 108 to carry the received refrigerant, in the vapor form, as well as the oil separated by the oil separator unit 202 to the compressor 406.

In some example embodiments, a refrigerant pipe 414 may be coupled to the oil separator inlet tube 110 of the accumulator and oil separator device 100. The refrigerant pipe 414 may transport the refrigerant, which may be a compressed hot gas mixed with lubricant oil, from the compressor 406 to the accumulator and oil separator device 100. The oil separator unit 202 may receive the refrigerant and oil mix from the compressor 406 through the oil separator inlet tube 110 and separate the oil and the refrigerant from each other as described above. As described above, the separated oil may be returned to the compressor 406 through the accumulator outlet tube 108 along with the refrigerant, in vapor form, received by the accumulator and oil separator device 100 from the evaporator coil 402.

In some example embodiments, a refrigerant pipe 416 may be coupled to the oil separator outlet tube 112 of the accumulator and oil separator device 100. The refrigerant pipe 416 may transport the refrigerant separated by the oil separator unit 202 from the accumulator and oil separator device 100 to the condenser coil 404.

As illustrated in FIG. 4, the use of the accumulator and oil separator device 100 in the air conditioning system 400 eliminates the need for separate accumulator and oil separator system components. The use of the accumulator and oil separator device 100 can ease installation of the air conditioning system 400 by eliminating the need for multiple spaces to separately install an accumulator and an oil separator. A separate oil return line typically required with a standalone oil separator is also eliminated by using the accumulator and oil separator device 100.

In some example embodiments, the system 400 may include components other than shown in FIG. 4 without departing from the scope of this disclosure. For example, the system 400 may include valve(s), filter(s), a drier(s), etc. in one or more of the refrigerant lines as can be readily understood by those of ordinary skill in the art with the benefit of this disclosure.

Figure 5:
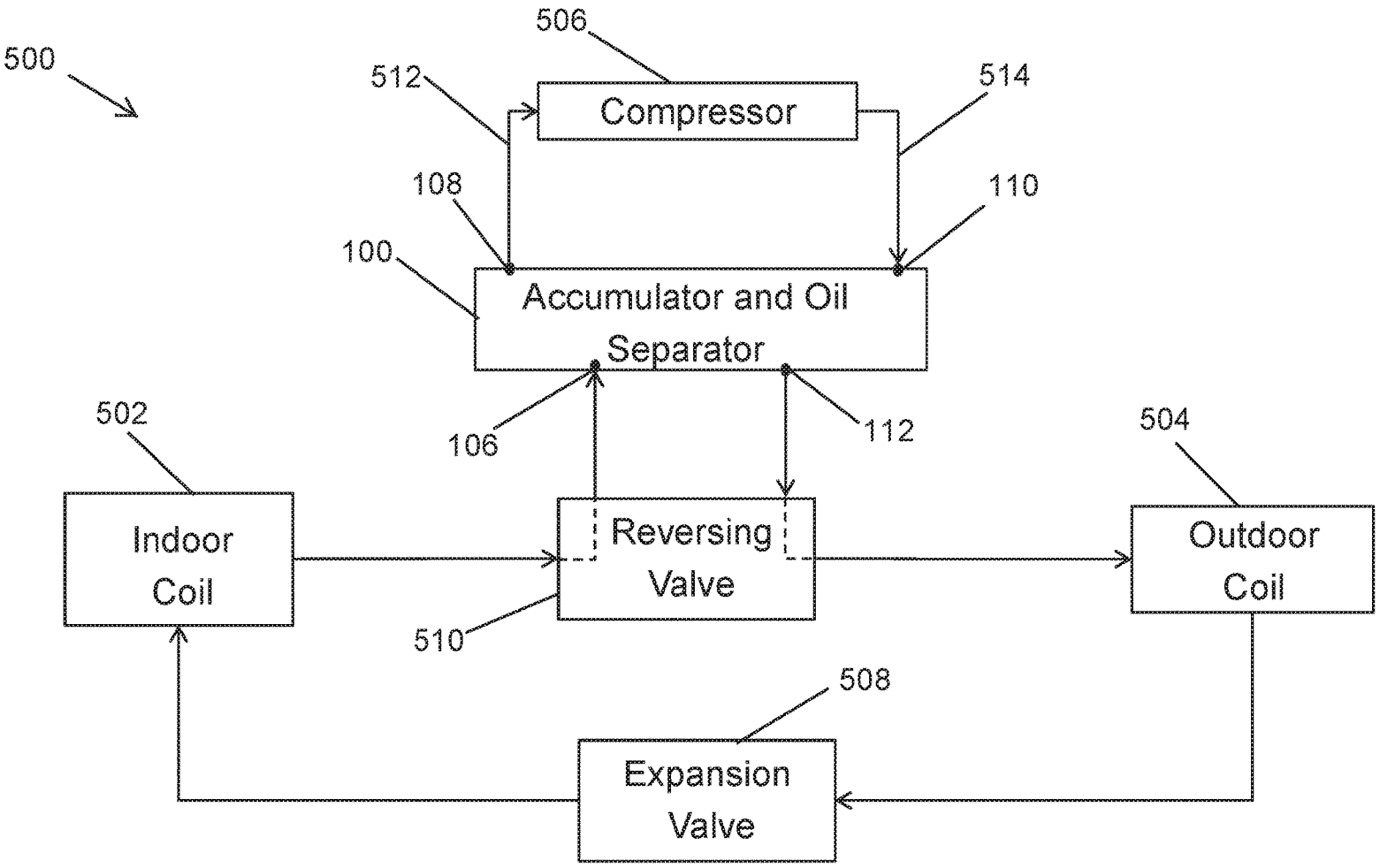
FIG. 5 illustrates a heat pump system including the accumulator and oil separator device of FIG. 1 configured for a cooling operation according to an example embodiment.
Figure 6:
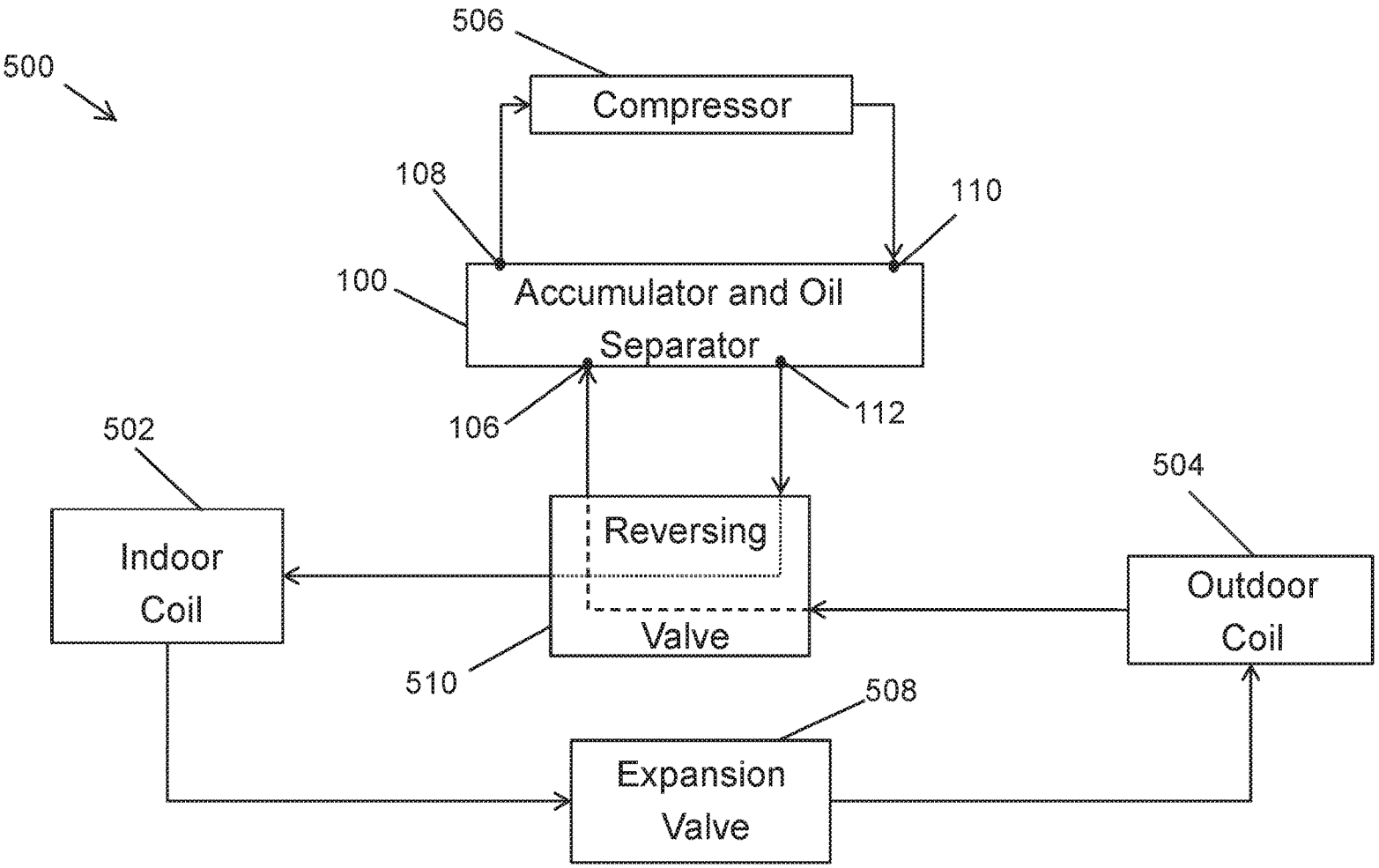
FIG. 6 illustrates a heat pump system including the accumulator and oil separator device of FIG. 1 configured for a heating operation according to an example embodiment.

FIG. 5 illustrates a heat pump system 500 including the accumulator and oil separator device 100 of FIG. 1 configured for a cooling operation according to an example embodiment. FIG. 6 illustrates the heat pump system 500 including the accumulator and oil separator device 100 of FIG. 1 configured for a heating operation according to an example embodiment. Referring to FIGS. 1-3, 4, and 5, in some example embodiments, the system 500 includes an indoor coil 502, an outdoor coil 504, a compressor 506, and an expansion valve 508. In some example embodiments, the system 500 may also include a reversing valve 510 that can be configured for a cooling operation as shown in FIG. 5 or for a heating operation as shown in FIG. 6.

In some example embodiments, when the system 500 is configured to operate in a cooling mode, the system 500 operates in a similar manner as described above with respect to the system 400. To illustrate, the indoor coil 502 may operate as an evaporator coil to cool down an indoor space, and the outdoor coil 504 may operate as a condenser coil to remove heat from the refrigerant circulating through the system 500.

In contrast, when the system 500 operates in a heating mode to heat an indoor space, the indoor coil 502 may operate as a condenser coil to remove from the refrigerant, and the outdoor coil 504 may operate as an evaporator coil. When operating in a heating mode, the reversing valve 510 allows the system 500 to operate in a similar manner as described with respect to the system 400, where the indoor coil 502 corresponds the condenser coil 404, and where the outdoor coil 504 corresponds to the evaporator coil 402.

In some example embodiments, the system 500 may include components other than shown in FIGS. 5 and 6 without departing from the scope of this disclosure. For example, the system 500 may include valve(s), filter(s), a drier(s), etc. in one or more of the refrigerant lines as can be readily understood by those of ordinary skill in the art with the benefit of this disclosure.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. An accumulator and oil separator device, comprising:

a housing having a housing cavity;

an oil separator unit comprising a shell having a shell cavity, and a float disposed within the shell cavity and configured to control an output of oil into the housing cavity based on a surface level of separated oil, wherein the oil separator unit is disposed in the housing cavity and wherein the oil separator unit is designed to separate oil from a refrigerant and oil mix received from a compressor;

an oil separator inlet tube extending from outside the housing to a top cover of the shell, wherein the oil separator unit receives the refrigerant and oil mix from outside of the housing via the oil separator inlet tube;

an oil return tube extending from a top cover of the shell and configured to output the oil onto the top cover of the shell and into the housing cavity;

an accumulator inlet tube to carry a received refrigerant into the housing cavity; and an accumulator outlet tube to output the received refrigerant and the oil from the housing cavity.

2. The device of claim 1, wherein the oil separator inlet tube extends through the housing cavity to the oil separator unit.

3. The device of claim 1, further comprising an oil separator outlet tube to output a separated refrigerant from the oil separator unit to outside of the housing, wherein the separated refrigerant is separated from the refrigerant and oil mix.

4. The device of claim 1, wherein the accumulator outlet tube comprises an output opening, wherein the received refrigerant and the oil exit the accumulator and oil separator device through the output opening.

5. The device of claim 4, wherein the accumulator outlet tube comprises a refrigerant inlet opening, wherein the refrigerant inlet opening is positioned in the housing cavity to receive the received refrigerant into the accumulator outlet tube in a vapor form.

6. The device of claim 5, wherein the accumulator outlet tube comprises a metering orifice, wherein the metering orifice is positioned to meter the separated oil into the accumulator outlet tube.

7. The device of claim 4, wherein the accumulator outlet tube is a J-shaped tube.

8. The device of claim 1, wherein the housing comprises a top wall and wherein the oil separator inlet tube extends from outside of the housing to the oil separator unit through the top wall.

9. The device of claim 1, wherein the oil separator unit is suspended in the housing cavity.

10. An air conditioning system, comprising:

an evaporator coil;

a condenser coil;

a compressor; and an accumulator and oil separator device, wherein the compressor is in fluid communication with the evaporator coil and the condenser coil through the accumulator and oil separator device, and wherein the accumulator and oil separator device comprises:

a housing having a housing cavity;

an oil separator unit comprising a shell having a shell cavity, and a float disposed within the shell cavity and configured to control an output of oil into the housing cavity based on a surface level of separated oil, wherein the oil separator unit is disposed in the housing cavity, wherein the oil separator unit is designed to separate oil from a refrigerant and oil mix received from the compressor;

an oil separator inlet tube extending from outside the housing to a top cover of the shell, wherein the oil separator unit receives the refrigerant and oil mix from outside of the housing via the oil separator inlet tube;

an oil return tube extending from a top cover of the shell and configured to output the oil onto the top cover of the shell and into the housing cavity;

an accumulator inlet tube to carry a refrigerant into the housing cavity; and an accumulator outlet tube to output the refrigerant and the oil from the housing cavity to the compressor.

11. The system of claim 10, wherein the oil separator inlet tube extends through the housing cavity to the oil separator unit.

12. The system of claim 10, wherein the accumulator and oil separator device further comprises an oil separator outlet tube to output a separated refrigerant from the oil separator unit to the condenser coil, wherein the separated refrigerant is separated from the refrigerant and oil mix.

13. The system of claim 10, wherein the accumulator inlet tube receives the refrigerant from the evaporator coil.

14. The system of claim 10, wherein the refrigerant in the housing cavity enters the accumulator outlet tube in a vapor form through a refrigerant inlet opening of the accumulator outlet tube and wherein the oil enters the accumulator outlet tube through a metering orifice of the accumulator outlet tube.

15. A heat pump system, comprising:

an indoor coil;

an outdoor coil;

a compressor;

a reversing valve; and an accumulator and oil separator device, wherein the compressor is in fluid communication with the indoor coil and the outdoor coil through the accumulator and oil separator device and the reversing valve, and wherein the accumulator and oil separator device comprises:

a housing having a housing cavity;

an oil separator unit comprising a shell having a shell cavity, wherein the oil separator unit is disposed in the housing cavity, wherein the oil separator unit is designed to separate oil from a refrigerant and oil mix received from the compressor, and wherein the oil separator unit outputs the oil into the housing cavity;

an oil separator inlet tube extending from outside the housing to a top cover of the shell, wherein the oil separator unit receives the refrigerant and oil mix from outside of the housing via the oil separator inlet tube;

an oil return tube extending from a top cover of the shell and configured to output the oil onto the top cover of the shell;

an accumulator inlet tube to carry a refrigerant into the housing cavity; and an accumulator outlet tube to output the refrigerant and the oil from the housing cavity to the compressor.

16. The system of claim 15, wherein the oil separator inlet tube extends through the housing cavity to the oil separator unit.

17. The system of claim 15, wherein the accumulator and oil separator device further comprises an oil separator outlet tube to output a separated refrigerant from the oil separator unit to the indoor coil or the outdoor coil, wherein the separated refrigerant is separated from the refrigerant and oil mix.

18. The system of claim 15, wherein the accumulator inlet tube receives the refrigerant from the indoor coil or the outdoor coil depending on a state of the reversing valve.

19. The system of claim 15, wherein the refrigerant carried into the housing cavity by the accumulator inlet tube enters the accumulator outlet tube in a vapor form through a refrigerant inlet opening of the accumulator outlet tube and wherein the oil enters the accumulator outlet tube through a metering orifice of the accumulator outlet tube.

* * * * *